United States Patent [19]

Lin

[11] Patent Number: 4,915,544

[45] Date of Patent: Apr. 10, 1990

[54] METHOD OF MAKING CAST-IN-PLACE PRESTRESSING CONCRETE PILE BY MEANS OF MOVABLE CASING SET

[76] Inventor: Juei-Jse Lin, Room C, 11F., No. 122, Sec. 4, Chung Hsiao E. Rd., Taipei, Taiwan

[21] Appl. No.: 766,786

[22] Filed: Aug. 19, 1985

[51] Int. Cl.[4] ..... E02D 5/38

[52] U.S. Cl. ..... 405/243; 405/239; 405/257

[58] Field of Search ..... 405/233, 239, 243, 257, 405/237, 238, 240, 242

[56] References Cited

U.S. PATENT DOCUMENTS

| | | | |
|---|---|---|---|
| 1,607,613 | 11/1926 | Upson | 405/243 |
| 1,912,089 | 5/1933 | Moe | 405/243 |
| 1,969,229 | 8/1934 | Marsden | 405/243 |
| 2,797,466 | 7/1957 | Lidberg | 405/243 |
| 4,043,133 | 8/1977 | Yegge | 405/239 |

FOREIGN PATENT DOCUMENTS

| | | | |
|---|---|---|---|
| 1157720 | 6/1958 | France | 405/243 |

*Primary Examiner*—David H. Corbin

*Attorney, Agent, or Firm*—Lane and Aitken

[57] ABSTRACT

A method of making a cast-in-place prestressed pile by means of a movable casing set composed of some separable casings which can be displaced vertically, and pull and push each other after displacing. Reinforcing cage and prestressing strands can be placed within the casing set. After grouting, each section, the casings can be pulled out one by one with an external force to overcome friction between the earth and casings till complete removal of all casing, a cast-in-place pile is then formed, and the movable casing set can be used at another spot.

2 Claims, 6 Drawing Sheets

METHOD OF MAKING CAST-IN-PLACE PRESTRESSING CONCRETE PILE BY MEANS OF MOVABLE CASING SET

BACKGROUND OF THE INVENTION

1. Field of the Invention

The present invention relates to a method for making a pile, particularly a method of making a cast-in-place prestressed concrete pile using a removable casing set for providing the greatest displacement, prestressing and absence of soil sediment.

Among the existing methods for constructing piles, each pile constructed may require a steel pile sheath, if a long pile is made, because the steel pile sheath can not be pulled out, because of the great friction between the steel pile and earth. This unnecessarily increases the cost of pilings. In addition, because transportation of the additional sheaths requires a considerable time and space, transportation cost is unnecessarily high, too. Using prestressed concrete piles usually requires precasting, transportation and stacking the piles at the site. The reverse circulation drilling method, on the other hand, may produce an eccentric structure, and collapse may occur due to soil loosening, which even careful control of water pressure can not overcome. None of these are ideal pile construction methods.

SUMMARY OF THE INVENTION

The present invention provides a method for making piles using a movable casing set. The casings are vertically displaced and then pulled out one by one, and the mortar is poured section by section, till the last casing pulled out. A cast-in-place pile is thus completed, and the removable casing set can be used at another spot for making another pile.

The removable casing set is characterized by the particular type of section by section separation provided by the casing set which overcomes friction between the earth and the casing, so that pulling out the casing set requires only a small force. Since it is not necessary to use a steel pile sheath for each pile constructed, this removable casing set also saves cost.

Another characteristic of the removable casing set is its great displacement that produces a great counter pressure which makes it easy to form the pile.

The present invention is further characterized by a close contact between the mortar surface of the pile and the earth. The poor adhesion and low friction which happen with some common precast piles and steel piles respectively, are eliminated.

The present invention is further characterized by the cast-in-place property which eliminates the need for precasting or the prefabrication of multiple steel pile sheaths. Also, since single removable casing set can be used to construct a number of piles, it is particularly advantageous for large projects.

The present invention is further characterized by the use of a conical pile head on bottom of the movable casing set which provides a great earth displacement, producing a great counter pressure to assure adhesion and friction between the pile and the earth and thus prevent the pile from sinking.

DESCRIPTION OF THE PREFERRED EMBODIMENT

Figure 1:
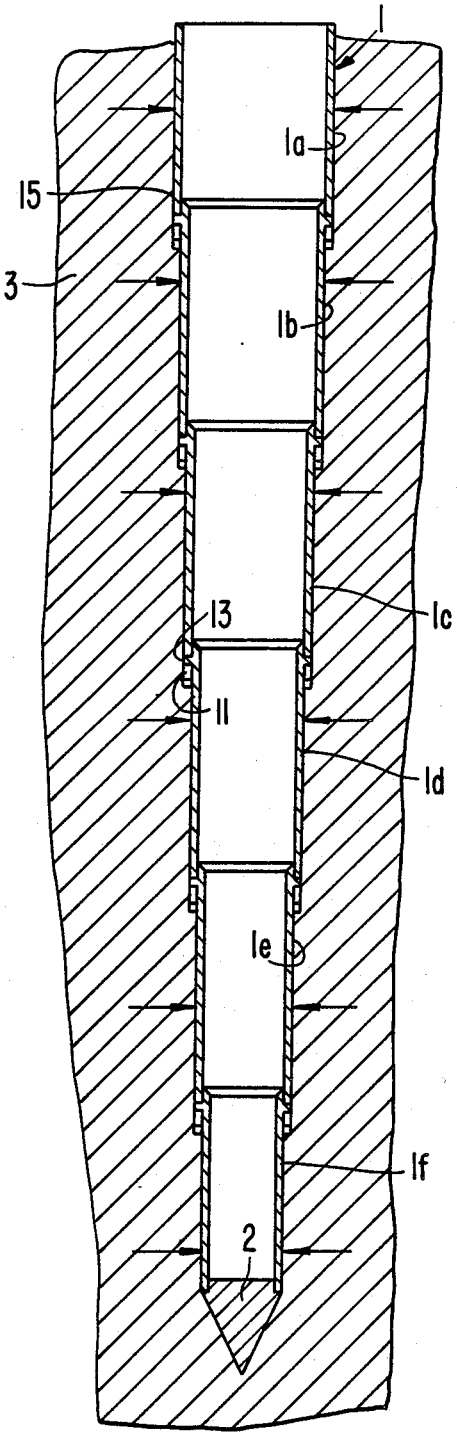
FIG. 1 is a sectional view illustrating penetration of a removable casing set into the earth according to the present invention.

FIG. 1 illustrates a removable casing set 1 and a conical pile head 2 according to the present invention after being driven into the earth 3 so as to cause a significant displacement of the earth. In the present embodiment the removable casing set 1 is composed of six casings 1*a*, 1*b* 1*c* 1*d*, 1*e* and 1*f*, each of which can be separated from its adjacent casing, can be displaced up and down, and pulls or pushes other casings after that displacement. The casings in the removable casing set 1 are connected to each other from the top to the bottom, preferably by inside lapping, to form a taper to facilitate penetration into or removal from the earth.

Figure 2:
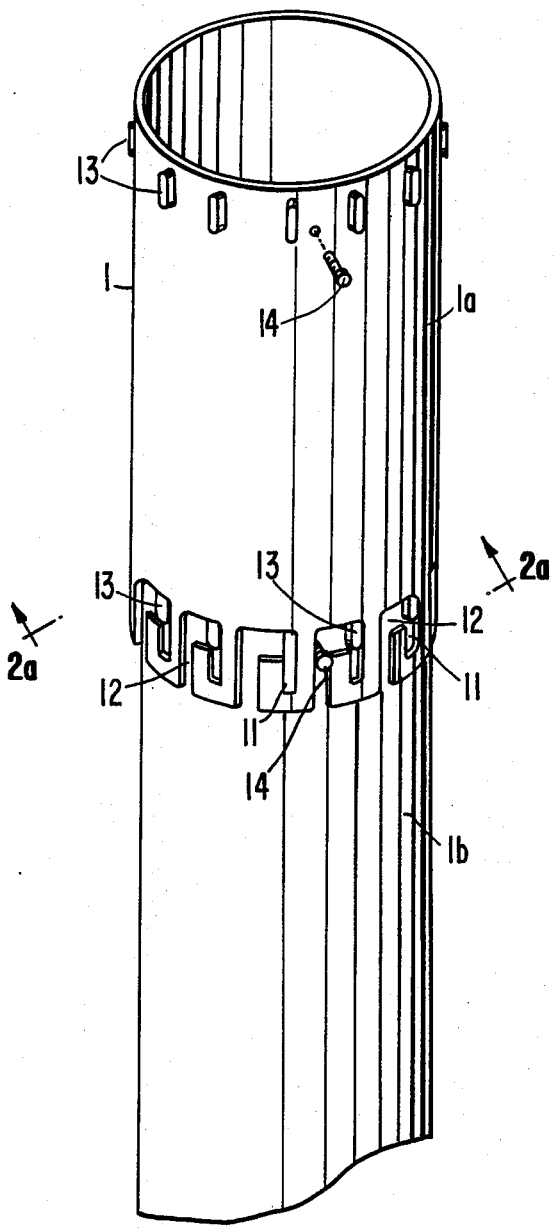
FIG. 2 is a perspective view of two upper removable casing sets representing an embodiment of the present invention that has been driven into the earth.
Figure 2A:
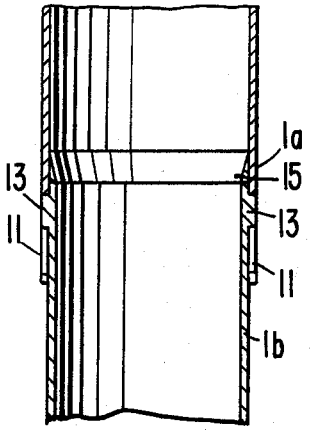
FIG. 2*a* is a sectional view along the line 2*a*–2*a* in the direction indicated by the arrows FIG. 2.
Figure 2B:
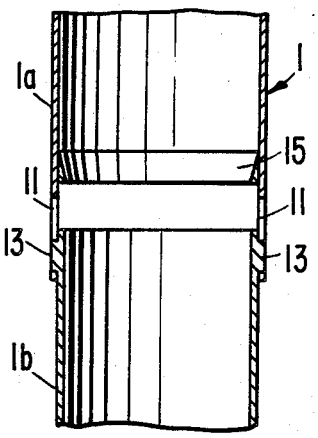
FIG. 2*b* is the sectional view of the removable casing set illustrated in FIG. 2*a* while pulling out the casings shown in FIG. 2*a*.

FIGS. 2, 2*a* and 2*b* illustrate a preferred embodiment for a removable casing set 1 according to the present invention. Around the lower end of the casing 1*a*, moving slots 11 and disengaging slots 12 are arranged in equal intervals. Around the upper end of the casing 1*b*, blocks 13 of equal height are arranged in equal intervals in a manner such that the blocks 13 can be freely moved up and down within the moving slots 11. FIG. 2*a* shows a sectional view of a block 13 in the upper portion of a moving slot 11, and FIG. 2*b* shows a sectional view of a block 13 at bottom portion of a moving slot 11. In the vertical portion of each disengaging slot 12 there is a positioning screw 14 to lock the lower casing 1*b* relative to the upper casing. The positioning screw 14 and the disengaging slot 12 are movable relative to each other along vertical position only and the casings are, thus, fixed in a locked position in that no lateral movement is possible, thereby preventing rotational displacement between two adjacent casings that would unlock them and allow them to separate.

To disengage casings in the embodiment shown in FIG. 2, remove the positioning screw 14 after the block 13 reaches the upper portion of the moving slot 11. Then, rotate the upper casing 1*a* counterclockwise till the block 13 is just located in the vertical portion of the disengaging slot 12 on the left, and pull the upper casing 1*a* upwards so that the upper and lower casings 1*a* and 1*b* separate from each other. Vertical displacement and separation of any two adjacent casings within the movable casing set 1 are also accomplished as described above.

When the casing set 1 is driven into the earth 3 by external force, the casings 1*a*, 1*b*, 1*c*, 1*d*, 1*e* and 1*f* compress, closing in upon each other one by one as that shown in FIG. 2*a* so that the upper edge of the lower casing 1*b* pushes against a support ring 15 installed in interior of the end of the upper casing 1*a* to reinforce against bearing force and to prevent the block 13 from breaking from the external force used to push the casings. Whenever the upper casing 1*a* is pulled by external force, the adjacent casings 1*a* and 1*b* extend in the manner shown in FIG. 2*b*.

Figure 3:
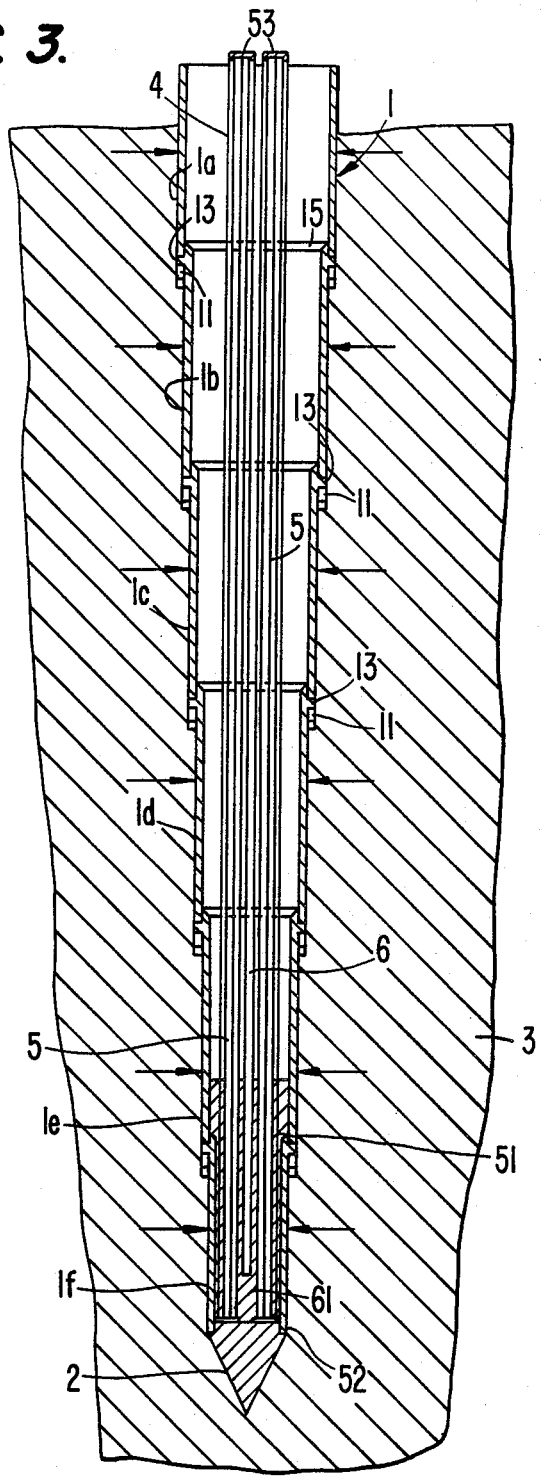
FIG. 3 is a sectional view illustrating grouting to a certain height after placing a reinforcing cage and prestressing strands within the removable casing set.

FIG. 3 illustrates placement of a reinforcing case 4 and prestressing strands 5 in the removable casing set 1 as well as pouring mortar 61 via a grouting pipe 6 up to the level of the second casing le from the bottom after driving the movable casing set 1 into the ground 3. Then, the casing set 1 is pulled upwards and these steps are repeated.

Figure 4:
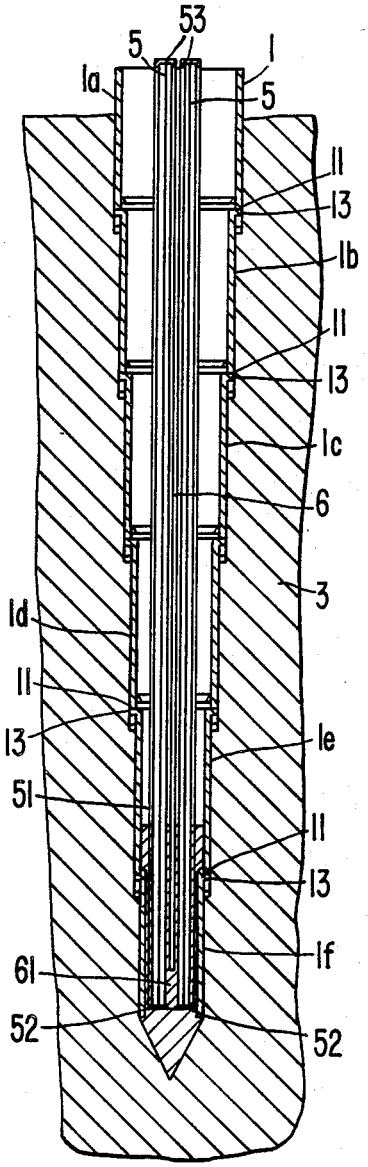
FIG. 4 is a sectional view illustrating pulling the removable casing set upward after grouting as indicated in FIG. 3.

As shown in FIG. 4, while the removable casing set 1 is being pulled upwards, the first casing which moves out is the top casing 1*a* as shown in FIGS. 2*a* and 2*b*. While the first casing 1*a* is displaced the other casings 1*b*, 1*c* 1*d*, 1*e* and 1*f* remain stationary. Thus, only a force to overcome the static friction between the earth 3 and the first casing 1*a* is required. The friction is much less than that between the earth and a conventional pipe pile. Thus, pulling the casing in accordance with the present invention is easier than for the prior art.

As soon as the upward moving casing la comes to the position shown in FIG. 2*b*, it starts to pull the second casing 1*b* upwards. It is very easy to overcome the friction between the earth 3 and the second casing 1*b* and thus move the second casing 1*b* for a certain distance, and then start to pull the third casing 1*c*, and so on, until the last casing 1*f* is pulled. The overall process requires an external force to overcome friction at the casing 1*a* 1*b*, 1*c*, 1*d* 1*e* and 1*f* one by one for pulling them upward.

The longer the length of each casing 1*a*, 1*b* 1*c*, 1*d*, 1*e* or 1*f*, the greater the friction. Therefore, generally, the most suitable length is 3–6 meters each, which may be increased or decreased according to soil conditions and work requirements. The height of the moving slot 11 from its top to its bottom can be preset according to actual need. For instance, that illustrated by the embodiment shown in FIG. 4 is 0.5 meters, and the total upward displacement is 2.5 meters.

After upward displacement of the complete removable casing set 1, the removable casing set 1 can be pulled up easily since there is a small gap between it and the earth because of the conical design of the casing set 1.

Figure 5A:
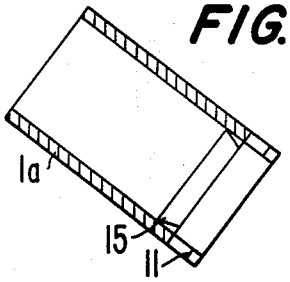
FIG. 5A is a sectional view illustrating the uppermost casing removed from the structure shown in FIG. 5.
Figure 5:
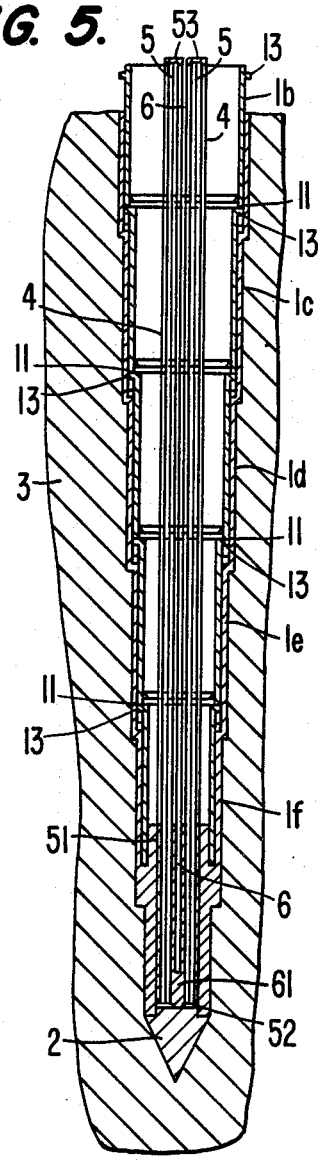
FIG. 5 is a sectional view illustrating action after that in FIG. 4 wherein the uppermost casing has been removed and mortar more than one meter in height remains in the lowest casing.

FIG. 5 shows a continuation of the pulling motion illustrated in FIG. 4 - the upper most casing 1 has been removed in a manner as shown in FIG. 2, and mortar of more than one meter in height has been reserved in the last casing lf to prevent earth from collapsing due to absence of casing lf support during grouting, or an adverse effect of the counter pressure from the earth before grouting. After removing the upper most casing 1*a* mortar is poured Then, after removing the upper most casing from the movable casing 1*e*. set 1, a mortar section 61 of at least 1 meter in height remains in the lowest casing 1*f*.

Figure 6A:
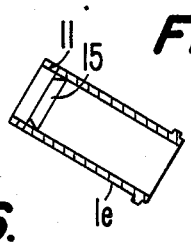
FIG. 6A is a sectional view of the second lowest casing removed from the structure shown in FIG. 6.
Figure 6:
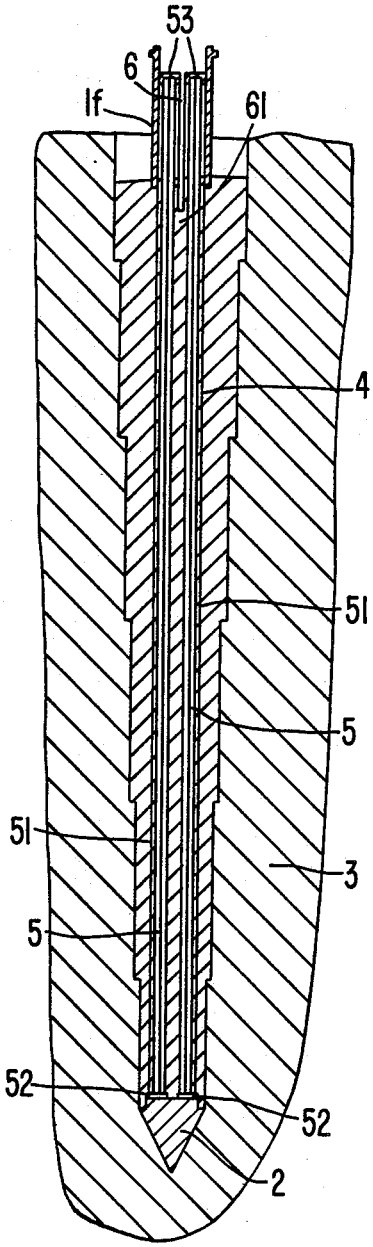
FIG. 6 is a sectional view illustrating the section by section grouting and removal of the casing set wherein the lowest casing is now on the top.

FIG. 6 shows the pile after the lowest casing 1*f* has been pulled to the uppermost position after grouting, during casing separation and removal in the manner described above. At this time, the last casing 1*f* can be removed after grouting.

The aforesaid prestressing strand 5 is placed within a protection pipe 51 and connected to a control block 52 at the bottom. The protection pipe is sealed by a cover 53 on its top. After grouting and hardening of concrete mortar, the cover 53 is opened, the strand therein is tensioned and the pipe filled with concrete mortar to form a prestressed concrete pile which can bear a larger lateral force.

Figure 7:
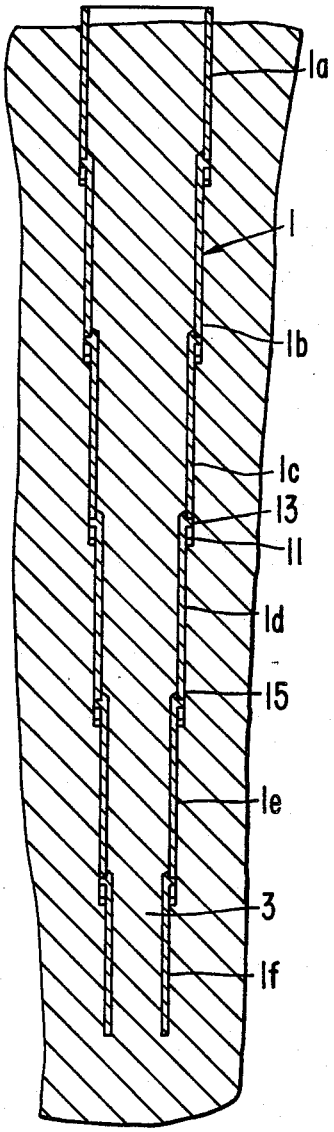
FIG. 7 is a sectional view of another embodiment of the present invention without the pile head, after being driven into the earth.

FIG. 7 is a sectional view of another embodiment of the present invention showing a movable casing set 1 without pile head, after it has penetrated into the earth. The casing set of this embodiment is subject to less friction while penetrating into the earth 3 and a small counter pressure for its small displacement will be encountered. For this embodiment, earth within the movable casing set 1 must be discharged to facilitate placing a reinforcing cage 4 and grouting the pile as described for the first embodiment.

Figure 9:
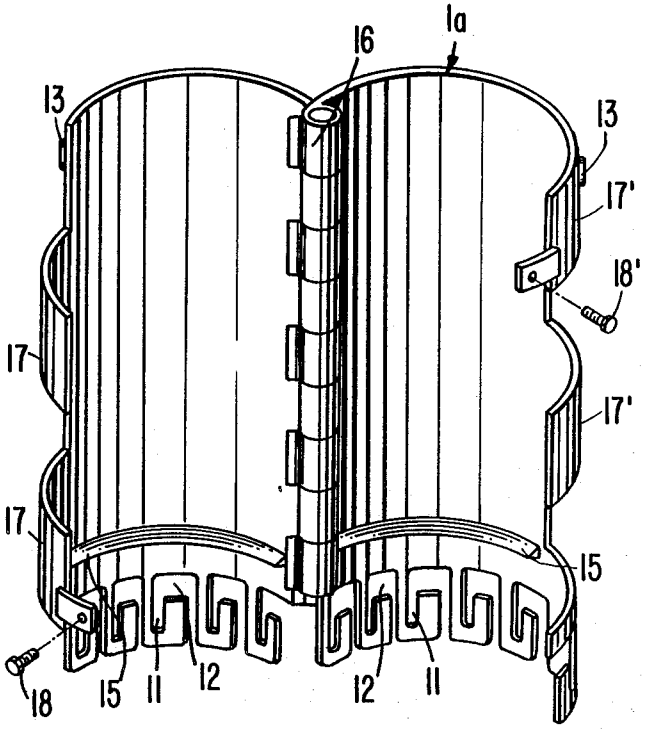
FIG. 9 is a perspective view of the casing illustrated in FIG. 8 in open condition.
Figure 8:
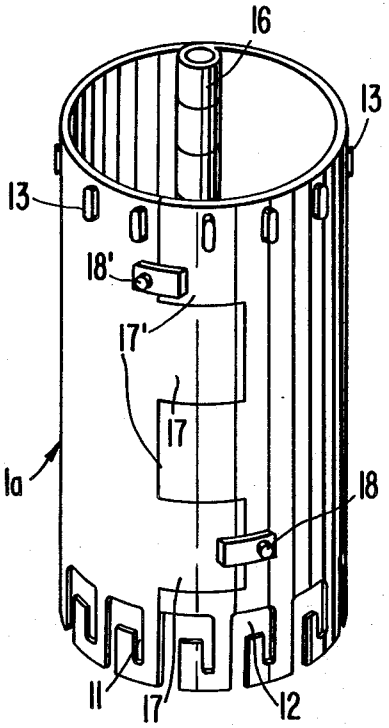
FIG. 8 is a perspective view of an embodiment of a casing showing a longitudinal opening therein according to the present invention.

FIGS. 8 and 9 illustrate another embodiment of the present invention which can be opened sidewise. The design facilitates removal of casings 1*a* 1*b* 1*c*, 1*d* and 1*e* by opening each of them sidewise at the time illustrated in FIGS. 5 and 6 without removing the grouting pipe located therein. As for the last casing 1*f*, sidewise opening design is not necessary since it will be removed only after grouting, after the grouting pipe 6 has been moved to the upper most position. In the embodiment as illustrated in FIGS. 8 and 9, there is a hinge 16 at the back of the casing 1*a* and there are toothed edges 17 and 17' in its front in order to withstand high impact force. There are fixing screws 18 and 18' along the edges 17 and 17' to fasten the edges together. Loosening the screws 18 and 18' permits the casing to open sidewise.

In conclusion the present invention, particularly the first embodiment has the following merits:

(1) It eliminates contamination due to earth discharge when making cast-in-place concrete piles.

(2) It eliminates collapse of the wall of the pile hole for a cast-in-place concrete pile, or "thin waist" which may occur due to water pressure and earth pressure.

(3) It eliminates occurrance of large soil deposits within pile hole of cast-in-place pile.

(4) It eliminates defect of loss of pile friction due to lateral soil disturbance and the small displacement of the cast-in-place pile.

(5) It eliminates the loss of strength caused by grouting in water for a cast-in-place pile.

(6) Prestressing can be applied in the present invention to form a prestressed concrete cast-in-place pile to afford greater resistance to lateral pressure in order to prevent buckling of the pile.

(7) It eliminates the problem of not being able to pull out the long steel sheath of a cast-in-place pile.

(8) The casing set according to the present invention is conical in form after connection of its component casings; therefor pulling it out is easy and there is greater friction between the pile and the earth.

What is claimed is:

1. A method of making a cast-in-place pile by means of a series of casings rotatble relative to each other between locked and unlocked positions, said locked position permitting a given vertical displacement between any two adjacent casings, displacement of the casings toward one another being limited by an abuttment affixed to one casing which is pushed by the adjacent casing when the casings are pushed together, said method comprising the steps of:

a. driving a casing into the earth;

b. engaging another casing with said casing of step a and rotating said casings relative to each other into the locked position;

c. repeating steps a and b until the casing extends into the earth to the depth desired for the pile, thereby pushing said casings against the respective abuttments so as to drive the casings into the earth in a compressed state;

d. pouring mortar into the lowermost casing to form a section of the pile and allowing it to hardern;

e. pulling on the casings so that the casings are displaced from each other one by one;

f. pulling a casing out of the earth to raise the lowermost casing into position wherein said lowermost casing slightly overllaps the hardened mortar, for forming another section of the pile; and g. repeating step d through f until all sections of the pile are formed and hardened, whereupon the lowermost casing is pulled out of the earth.

2. The method as claimed in claim 1 further comprising the step of applying positioning means to the casings after they are engaged and rotated relative to each other so that further rotation is prevented and the casing can be reliably pulled out without separating when in the locked position.

* * * * *